United States Patent [19]

Kohmura et al.

[11] Patent Number: 5,060,024

[45] Date of Patent: Oct. 22, 1991

[54] METHOD AND APPARATUS FOR CLEANING SQUEEZE ROLLERS IN LIQUID ELECTROPHOTOGRAPHIC DEVELOPING APPARATUS

[75] Inventors: Isao Kohmura; Takao Senga; Sadao Kuriu, all of Nagaokakyo, Japan

[73] Assignee: Mitsubishi Paper Mills Limited, Tokyo, Japan

[21] Appl. No.: 365,733

[22] Filed: Jun. 14, 1989

[30] Foreign Application Priority Data

Jun. 17, 1988 [JP] Japan ..... 63-149314
Jul. 4, 1988 [JP] Japan ..... 63-166096

[51] Int. Cl.[5] ..... G03G 15/20; G03G 21/00

[52] U.S. Cl. ..... 355/283; 355/307; 355/77; 118/652

[58] Field of Search ..... 355/256–258, 355/283, 307, 259–261, 77; 118/661, 662, 652; 430/117–119

[56] References Cited

U.S. PATENT DOCUMENTS

| | | | |
|---|---|---|---|
| 3,769,896 | 11/1973 | Samuels et al. | 355/256 X |
| 3,820,891 | 6/1974 | Kurakawa et al. | 355/256 X |
| 4,091,404 | 5/1978 | Schörnig et al. | 118/662 X |
| 4,367,690 | 1/1983 | Sakaguchi et al. | 118/60 |
| 4,586,809 | 5/1986 | Miyauchi et al. | 118/662 X |

*Primary Examiner*—R. L. Moses
*Attorney, Agent, or Firm*—Cushman, Darby & Cushman

[57] ABSTRACT

The invention provides a method for cleaning squeeze rollers of a liquid electrophotographic developing apparatus by a cleaning pad which makes it possible to develop an electrophotographic photoreceptor with causing no stains. The method includes the steps of supplying a solvent for liquid developer to a pair of squeeze rollers thereby to clean the rollers with the solvent; isolating the squeeze rollers from each other; and allowing one of the rollers which contacts with photosensitive surface of photoreceptor and the cleaning pad to contact with each other thereby to clean the roller kept isolated from the other squeeze roller by the cleaning pad. The invention further provides a liquid electrophotographic developing apparatus for carrying out the method.

9 Claims, 3 Drawing Sheets

METHOD AND APPARATUS FOR CLEANING SQUEEZE ROLLERS IN LIQUID ELECTROPHOTOGRAPHIC DEVELOPING APPARATUS

BACKGROUND OF THE INVENTION

The present invention relates to a method for cleaning squeeze rollers in an apparatus for liquid electrophotographic development and a liquid electrophotographic developing method suitable for running process.

A schematic sectional view of a conventional electrophotographic developing apparatus is shown in FIG. 5. Corona charged and imagewise exposed electrophotographic photoreceptor 1 is led into a pair of development electrodes 9 and 10 by a pair of feed rollers 4 and 5 in the direction of the arrow in FIG. 5. Liquid developer 2 is uniformly fed from developer supplying slit 11 to development electrodes 9 and 10 by a pump (not shown) and is filled therein.

The electrophotographic photoreceptor developed in development electrodes 9 and 10 is passed through squeeze rollers 6 and 7 to remove excess liquid developer and then is delivered to the subsequent steps (e.g., drying and fixing steps). Cleaning pad 8 is made of a resilient material such as, for example, cotton in order to effectively remove fog and is held against upper squeeze roller 6 so that it wipes the roller by revolution of the roller and the excess developer removed from the surface of photosensitive layer of the photoreceptor is prevented from being again applied to the surface of the photosensitive layer from the roller.

The cleaning method using a cleaning pad is disclosed, for example, in Japanese Patent Kokai (Laid-Open) Nos. 50-15561, 50-98844 and 51-118437 and Japanese Utility Model Kokai (Laid-Open) No. 56-126656. However, such methods still do not have sufficient cleaning effect. Especially, a developing apparatus is not so often used in succession and is stopped during the night or on a holiday. During this stopping period the developer containing toners and remaining on the squeeze rollers is evaporated and sticks to the rollers as a film upon drying and besides the concentrated toners are locally hardened and damage the surface of the upper squeeze roller 6 when operation is restarted. Sometimes the squeeze rollers per se or cleaning pad 8 and the upper roller stick to each other to hinder the driving of the apparatus.

In case such intermittent developing treatment is carried out for a long time in running procedure, there are the problems such as consumption of liquid developer by electrophotographic photoreceptor and change in amount and composition of the liquid developer caused by evaporation of solvent in addition to the problem of sticking of squeeze rollers.

SUMMARY OF THE INVENTION

An object of the present invention is to provide a cleaning method and an apparatus used for this method which are free from the above mentioned problems in the conventional techniques, thereby to make it possible to develop an electrophotographic photoreceptor without causing stains.

Another object of the present invention is to provide a developing method free from the above-mentioned problems in the conventional techniques, namely, a liquid electrophotographic developing method which attains both the solution of the problem, i.e., sticking of a pair of squeeze rollers to each other during running treatment for a long time and securing of stable developing conditions, which can give stably good images free from stains and which greatly improves maintenance of developing apparatus and an apparatus used for this developing method.

DETAILED DESCRIPTION

Figure 1:
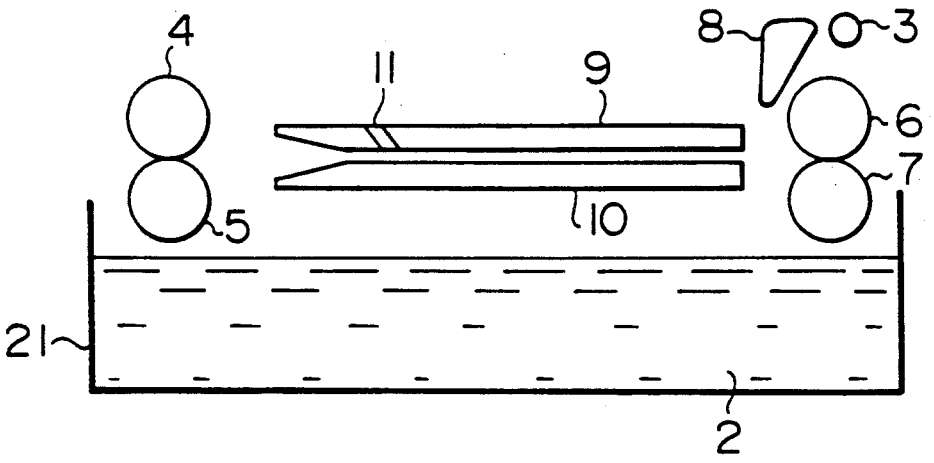
FIG. 1 is a schematic sectional view of a liquid electrophotographic developing apparatus provided with the device for cleaning squeeze rollers of the present invention.

The method for cleaning squeeze rollers with a cleaning pad in a liquid electrophotographic developing apparatus according to the present invention includes (a) cleaning a pair of squeeze rollers with a solvent for liquid developer, (b) isolating the squeeze rollers from each other and (c) contacting the squeeze roller which contacts with the photosensitive surface of photoreceptor with the cleaning pad and is characterized in that cleaning by the cleaning pad is carried out in such state that the squeeze rollers are isolated from each other.

Furthermore, the apparatus for successful practice of the above method of the present invention is a liquid electrophotographic developing apparatus provided with a cleaning means for squeeze rollers which has a pair of squeeze rollers for removing liquid developer on an electrophotographic photoreceptor, a cleaning pad and a means for supplying a solvent for liquid developer to said pair of squeeze rollers, and said cleaning pad is positioned apart from the squeeze rollers, the pair of squeeze rollers can be isolated from each other and the isolated roller which contacts with the surface of photosensitive layer can contact with the cleaning pad during cleaning.

Another object of the present invention referred to above can be attained by a method for developing an electrophotographic photoreceptor by a liquid electrophotographic developing apparatus having a pair of squeeze rollers, characterized in that after completion of development of the photoreceptor, a necessary amount of a solvent for liquid developer is supplied to the squeeze rollers to wash the rollers, then the solvent is recovered in a container for the liquid developer and a necessary amount of a liquid developer having higher solid concentration than the above-mentioned liquid developer is supplied to the container of the liquid developer.

This method of the present invention can be effectively and preferably practised by using a liquid electrophotographic developing apparatus which is provided with a means for supplying to a container containing a liquid developer a liquid developer having a higher solid concentration than the liquid developer in the container.

The present invention will be explained in more detail referring to the drawings.

Figure 2:
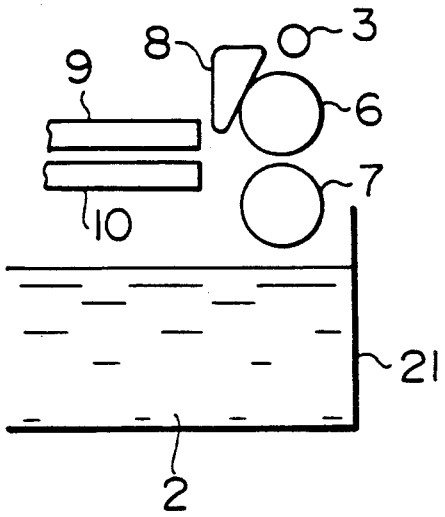
FIG. 2 is a schematic sectional view of essential parts which show the state when the cleaning rollers shown in FIG. 1 are under being cleaned.

FIG. 1 is a schematic sectional view of one example of the liquid electrophotographic developing apparatus provided with a device for cleaning squeeze rollers according to the present invention. FIG. 2 is a schematic sectional view of essential parts which show the state when the squeeze rollers in FIG. 1 is cleaned.

In FIG. 1, 11 indicates a slit for supplying the developer, through which liquid developer 2 is continuously supplied by a pump (not shown). 9 and 11 indicate a pair of developing electrodes which are normally composed of an electrically good conductor. 4 and 5 indicate a pair of feed rollers and 6 and 7 indicate a pair of squeeze rollers which are ordinarily insulating rubber rollers, but one of which may be a metallic roller in some case. 8 indicates a cleaning pad comprising a liquid absorbing material such as a cloth. 3 indicates a nozzle for supplying a solvent for liquid developer to the squeeze rollers.

As the liquid developer 2, there may be used well known developer comprising a highly insulating hydrocarbon solvent which contains a colorant such as pigment or dye, a coated resin or resin particles, a charge controlling agent, or the like. The solvent includes, for example, normal paraffin hydrocarbons, isoparaffinic hydrocarbons, alicyclic hydrocarbons and halogenated aliphatic hydrocarbons. From the points of safety and volatility, there may be practically used isoparaffinic hydrocarbon solvents such as Shell Sol 71 (Shell Petroleum Co.), Isoper O, Isopar H, Isopar K, Isopar L, and Isopar G (Exxon Co.) and IP Solvent (Idemitsu Petrochemical Co.). A solvent for liquid developer 2 is used as the solvent supplied from nozzle 3.

In FIG. 1, a corona charged and imagewise exposed electrophotographic photoreceptor is led between a pair of developing electrodes 9 and 10 by a pair of feed rollers 4 and 5. Liquid developer 2 is supplied from the developer supplying slit 11 into developing electrode 9 and 10 by a pump (not shown) and filled therein, where toner development of static latent image is carried out. The developed photoreceptor is passed between squeeze rollers 6 and 7 to remove excess liquid developer and then delivered to the subsequent steps (such as drying and fixing steps).

In case the photoreceptor is continuously developed, normally, cleaning of squeeze rollers 6 and 7 is not needed, but a cleaning step is necessary at the time of discontinuance or termination of operation.

The cleaning method of the present invention includes the following steps. In FIG. 1, the solvent fed to nozzle 3 from the container containing the solvent for liquid developer (not shown) is supplied in the form of shower to squeeze rollers 6 and 7 from slits or many holes of nozzle 3 provided in the lengthwise direction of the squeeze rollers 6 and 7. Liquid developer 2 adhered to squeeze rollers 6 and 7 is swept off by the revolution of the rollers [step (a)]. Then, the squeeze roller 6 is isolated from the squeeze roller 7 by well known elevating means (e.g., air cylinder driving mechanism) provided at shafts of both sides [step (b)]. The interval between the isolated squeeze rollers 6 and 7 is preferably about 0.5–5 mm, but may be longer than this range. Cleaning pad 8 is lowered by a known elevating means and is allowed to contact with the outer periphery of squeeze roller 6 as shown in FIG. 2 step (c)] and in this state the squeeze roller 6 is revolved to perform complete cleaning of the roller. After completion of cleaning, only the cleaning pad 8 is returned to the original position from the position shown in FIG. 2 and the next operation will be started. At the time of restarting of the development, squeeze rollers 6 and 7 are returned to the state as shown in FIG. 1 and function as squeeze rollers.

The above-mentioned steps (a), (b) and (c) may be conducted in the optional sequence as far as the final state is as shown in FIG. 2. For example, the sequence may be (b)→(a)→(c) or (a)→(c)→(b) or (b) and (c) or (a), (b) and (c) may be carried out at the same time. Furthermore, the isolation of the roller in the step (b) may be performed by lowering the squeeze roller 7 and the step (c) may be carried out by moving either one of cleaning pad 8 or squeeze roller 6 to allow pad 8 to contact with squeeze roller 6. Amount of the solvent to be supplied to squeeze rollers 6 and 7 from nozzle 3 varies depending on the size of squeeze rollers 6 and 7 (area of outer surface), but preferably is several ten ml to about several hundreds ml for one cleaning. The solvent may be supplied either continuously or intermittently.

Figure 3:
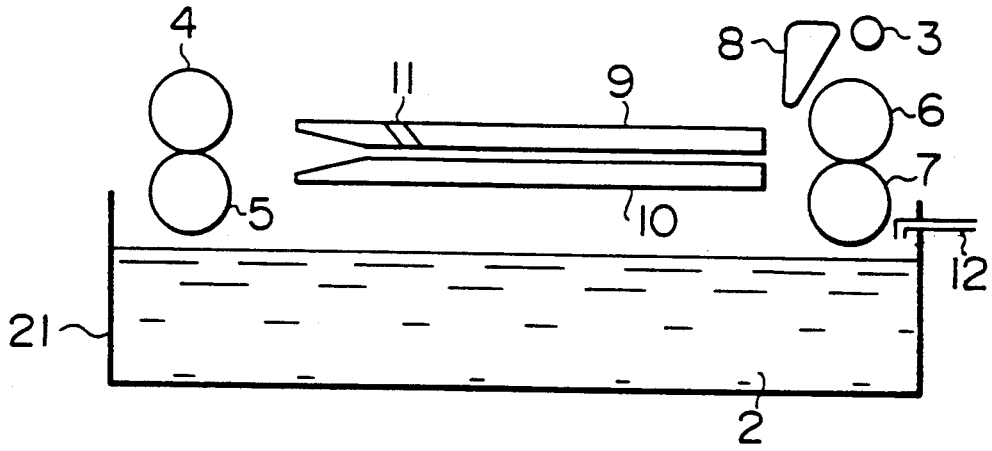
FIG. 3 is a schematic sectional view of a liquid electrophotographic developing apparatus provided with a pair of squeeze rollers suitable for practise of the present invention.
Figure 4:
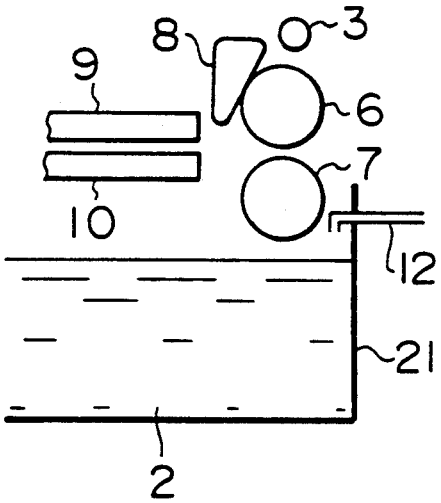
FIG. 4 is a schematic sectional view of essential parts which show the state when the squeeze rollers shown in FIG. 1 are under being cleared.

FIG. 3 is a schematic sectional view of one example of an apparatus used for practice of the liquid electrophotographic developing method of the present invention and FIG. 4 is a schematic partial sectional view which shows a preferred embodiment of the liquid electrophotographic developing method of the present invention.

The reference numbers 2–11 in FIGS. 3 and 4 have the same meanings as in FIG. 1. 12 indicates a nozzle for replenishment of a liquid developer of high concentration and 21 indicates a container for liquid developer. Solid concentration of the liquid developer 2 is generally in the range of about 0.3%—about 5% by weight and composition thereof is similar to that explained with reference to FIGS. 1 and 2. As the solvent supplied from nozzle 3, a solvent for liquid developer 2 is used.

In FIG. 3, a corona charged and imagewise exposed electrophotographic photoreceptor is led into a pair of developing electrodes 9 and 10 by a pair of feed rollers 4 and 5. Liquid developer 2 is uniformly fed into the developing electrodes 9 and 10 from developer supplying slit 11 by a pump (not shown) and is filled therein and toner development of static latent image is carried out therein. The developed photoreceptor is passed through squeeze rollers 6 and 7 to remove excess liquid developer and delivered to the subsequent steps (e.g., drying and fixing steps).

In case the photoreceptor is continuously developed, cleaning of squeeze rollers 6 and 7 is ordinarily not needed, but the cleaning step is necessary at discontinuance or termination of the operation.

In FIG. 3, the solvent fed to nozzle 3 from a container (not shown) containing the solvent for liquid developer is supplied in the form of shower to squeeze rollers 6 and 7 from slits or many holes of nozzle 3 provided in the lengthwise direction of the squeeze rollers 6 and 7. Liquid developer 2 adhering to squeeze rollers 6 and 7 is swept off by the revolution of the rollers [step (a)]. Then, the squeeze roller 6 is preferably isolated from the squeeze roller 7 by well known elevating means (e.g., air cylinder driving mechanism) provided at the shafts of both sides [step (b)]. The interval between the isolated squeeze rollers 6 and 7 is preferably about 0.5–5 mm, but may be longer than this range. Cleaning pad 8 is lowered by a known elevating means and is allowed to contact with the outer peripheral of squeeze roller 6 as shown in FIG. 4 [step (c)] and in this state the squeeze roller 6 is revolved to perform complete cleaning of the roller. After completion of cleaning, only the cleaning pad 8 is returned to the original position from the position shown in FIG. 4 and the next operation will be started. At the time of restarting of the development, squeeze rollers 6 and 7 are returned to the state as shown in FIG. 3 and function as squeeze rollers.

The above-mentioned steps (a), (b) and (c) may be conducted in the optional sequence. For example, the sequence may be (b)→(a)→(c) or (a)→(c)→(b) or (b) and (c) or (a), (b) and (c) may be carried out at the same time. Furthermore, the isolation of the roller in the step (b) may be performed by lowering the squeeze roller 7 and the step (c) may be carried out by moving either one of cleaning pad 8 or squeeze roller 6 to allow pad 8 to contact with squeeze roller 6. Furthermore, step (b) and/or step (c) may be omitted.

Amount of the solvent to be supplied to squeeze rollers 6 and 7 from nozzle 3, namely, required amount is at least the amount required for cleaning squeeze roller 6 and varies depending on the size of squeeze rollers 6 and 7 (outer peripheral area), amount of solvent of liquid developer replenished from nozzle 12 and quantity of photoreceptor treated (amount of consumed liquid developer 2) and cannot be simply specified, but generally is several ten milliliters to about several hundreds milliliters for one cleaning. The solvent in the required amount may be supplied either continuously or intermittently from nozzle 3 to squeeze rollers 6 and 7. The solvent which has been used for cleaning of squeeze rollers 6 and 7 falls as it is and is recovered in container 21 of liquid developer.

A required amount of a liquid developer having a solid concentration (about 0.6% by weight—about 30% by weight) which is several times to several ten times that of liquid developer 2 is supplied from nozzle 12 to container 21 of liquid developer. Supply of this liquid developer is carried out by uniformly diffusing it by a stirrer (not shown). Amount of this liquid developer of high concentration to be supplied is set so as to replenish toners in a solid amount nearly equal to that of solid amount of toners of liquid developer 2 consumed for development of one or more electrophotographic photoreceptors.

According to such method of the present invention, good images can be stably obtained during intermittent running treatment for a long period of time by effective cleaning of a pair of squeeze rollers with solvent for liquid developer and by replenishment of a high concentration liquid developer of toner solid content which counterbalances the amount of liquid developer 2 consumed by development of photoreceptor.

When a large quantity of electrophotographic photoreceptors are developed continuously over a long period of time, a solvent in an amount corresponding to the amount of solvent of liquid developer 2 which has been evaporated can be added to the solvent for cleaning of squeeze rollers 6 and 7 and can be supplied from nozzle 3. Moreover, with reference to the solvent which has been evaporated during suspension of operation for a long time, a solvent in an amount corresponding to the amount of the evaporated solvent can be supplied to container 21 directly or from nozzle 3. In either cases, there may be employed a method of control, for example, by constant-level regulation.

The developing apparatuses of FIGS. 1–4 are horizontal type because this is suitable for making printing plate having an aluminum sheet as a support. However, the present invention is not limited to such horizontal type, but may be the known inclined type. Furthermore, in case of the developing apparatus being horizontal, when the photoreceptor passes through the developing part, the liquid developer also adheres to the feed rollers and the problem which occurs in squeeze rollers also occurs in the feed rollers. In this case, therefore, the same cleaning mechanism as for the squeeze rollers can also be provided for the feed rollers.

According to the present invention, the squeeze rollers can be efficiently and simply cleaned before the liquid developer which adheres to the squeeze rollers sticks to the rollers. Therefore, reoperation after suspension for a long time can be conducted smoothly only with occasional exchanging of cleaning pad. Thus, maintenance becomes easy.

Figure 5:
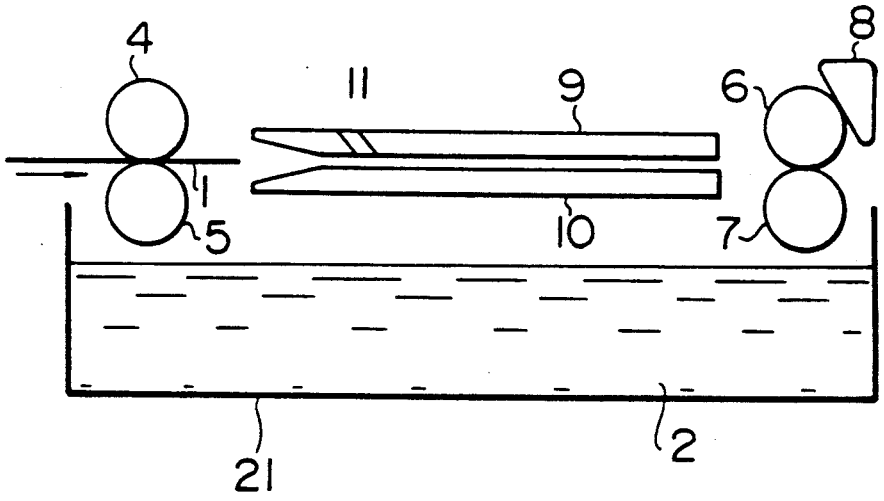
FIG. 5 is a schematic sectional view of a conventional liquid electrophotographic developing apparatus.

As compared with the conventional method by which cleaning is carried out by always contacting the cleaning pad with squeeze rollers as shown in FIG. 5, according to the present invention, the undried liquid developer adhering to the squeeze rollers can be efficiently cleaned with a small amount of solvent and besides stable developing can be effected during intermittent running treatment over a long period by replenishment of this cleaning solvent and high concentration liquid developer.

What is claimed is:

1. A method for cleaning squeeze rollers of a liquid electrophotographic developing apparatus by a cleaning pad comprising a liquid absorbing material which includes the steps of supplying a solvent for liquid developer to a pair of squeeze rollers thereby to clean the rollers with the solvent; isolating the squeeze rollers from each other; and allowing the roller which contacts the photosensitive surface of the photoreceptor to contact the cleaning pad, which action thereby cleans the roller.

2. A method for developing an electrophotographic photoreceptor in a liquid electrophotographic developing apparatus having a pair of squeeze rollers wherein after completion of development of the photoreceptor, the squeeze rollers are supplied with a required amount of a solvent for liquid developer and cleaned therewith and said solvent is recovered in a container for the liquid developer and simultaneously a required amount of a liquid developer having higher solid concentration than the liquid developer contained in the container is supplied to the container.

3. A method for developing an electrophotographic photoreceptor in a liquid electrophotographic developing apparatus having a pair of squeeze rollers and a cleaning pad which includes supplying a solvent for liquid developer to the squeeze rollers; isolating the squeeze rollers from each other; allowing one of the squeeze rollers which contacts a photosensitive surface of the electrophotographic photoreceptor, to contact the cleaning pad, which action thereby cleans the one of the rollers which contacts the photosensitive surface; recovering the solvent into a container for the liquid developer and supplying to the container a required amount of a liquid developer having a higher solid concentration than the liquid developer contained in the container.

4. A liquid electrophotographic developing apparatus which is provided with a pair of squeeze rollers, a cleaning pad comprising a liquid absorbing material, and a means for supplying a solvent for liquid developer to the squeeze rollers and a means for isolating said squeeze rollers from each other, thereby allowing one of the rollers which contacts a photosensitive surface of an electrophotographic photoreceptor, to contact the cleaning pad, which action thereby cleans the one of the rollers which contacts the photosensitive surface.

5. A liquid electrophotographic developing apparatus which is provided with a pair of squeeze rollers, a cleaning pad comprising a liquid absorbing material, and a means for supplying a solvent for liquid developer to the squeeze rollers, said squeeze rollers being able to be isolated from each other; and one of the rollers, which contacts a photosensitive surface of the electrophotographic photoreceptor, being able to contact the cleaning pad, which action thereby cleans the one of the rollers which contacts the photosensitive surface, and which said apparatus is additionally provided with a means to supply to a container for the liquid developer a liquid developer having higher solid concentration than the liquid developer in the container.

6. A method for cleaning squeeze rollers according to claim 1 wherein said roller which contacts the photosensitive surface of the photoreceptor is a rubber roller.

7. A liquid electrophotographic developing apparatus according to claim 4 wherein the roller which contacts the photosensitive surface of the photoreceptor is a rubber roller.

8. A method for cleaning squeeze rollers of a liquid electrophotographic developing apparatus by a cleaning pad comprising a liquid absorbing material which includes the steps of supplying a solvent for liquid developer to a pair of squeeze rollers thereby to clean the rollers with the solvent; isolating the rollers from each other; and allowing one of the rollers, which contacts a photosensitive surface of the electrophotographic photoreceptor and which is a rubber roller to contact the cleaning pad, which action thereby cleans said rubber roller.

9. A liquid electrophotographic developing apparatus which is provided with a pair of squeeze rollers, a cleaning pad comprising a liquid absorbing material, and a means for supplying a solvent for liquid developer to the squeeze rollers, means for isolating said squeeze rollers from each other; and thereby allowing one of the rollers, which contacts a photosensitive surface of the electrophotographic receptor, to contact the cleaning pad, said one of the rollers being a rubber roller which is cleaned by the action of said pad.

* * * * *